US006113436A

United States Patent [19]

Kuwahara et al.

[11] Patent Number: 6,113,436

[45] Date of Patent: Sep. 5, 2000

[54] SHOCK PREVENTING ELECTRICAL CONNECTOR PLUG

[75] Inventors: Masanori Kuwahara; Makoto Higashikozono, both of Mie, Japan

[73] Assignee: Sumitomo Wiring Systems, Ltd., Yokkaichi, Japan

[21] Appl. No.: 09/290,247

[22] Filed: Apr. 13, 1999

[30] Foreign Application Priority Data

Apr. 15, 1998 [JP] Japan ..... 10-104882
Oct. 2, 1998 [JP] Japan ..... 10-281129

[51] Int. Cl.[7] ..... H01R 13/04

[52] U.S. Cl. ..... 439/693

[58] Field of Search ..... 439/693, 692, 439/181, 732, 884

[56] References Cited

U.S. PATENT DOCUMENTS 3,474,386 10/1969 Link ..... 439/181

FOREIGN PATENT DOCUMENTS 61-194968 12/1986 Japan .
62-178477 11/1987 Japan .
62-178478 11/1987 Japan .
7282889 10/1995 Japan .
8203593 8/1996 Japan .
2659169 6/1997 Japan .
9148004 6/1997 Japan .

OTHER PUBLICATIONS

An English Language abstract of JP 7–282889, Oct. 27, 1995.

An English Language abstract of JP 8–203593, Aug. 9, 1996.

An English Language abstract of JP 9–148004, Jun. 6, 1997.

*Primary Examiner*—Lincoln Donovan
*Assistant Examiner*—Javaid Nasri
*Attorney, Agent, or Firm*—Greenblum & Bernstein, P.L.C.

[57] ABSTRACT

A connector is used for connecting the cables used in solar cell modules. The connector includes a plug and a socket. The plug is provided with an insulator to avoid electrical shock. Such a plug is easily and economically provided. The plug includes a plug core, an insulator projecting from the head portion of the plug core and a housing covering the plug core with a space adapted to receive part of the socket. The insulator includes a cap portion projecting from the head portion of the plug core, and a trunk portion to be fitted into the plug core. The trunk portion and the plug core are provided with corresponding fixing mechanism for preventing them from slipping out.

16 Claims, 5 Drawing Sheets

FIG. 5a
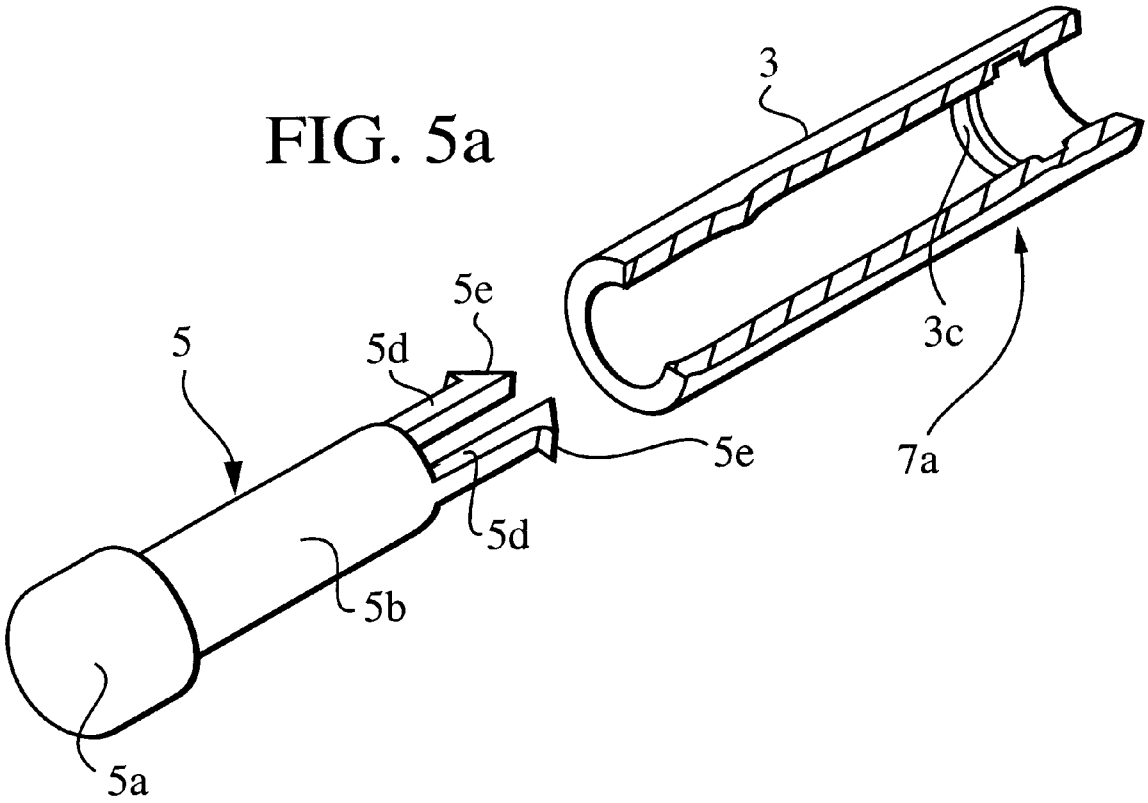
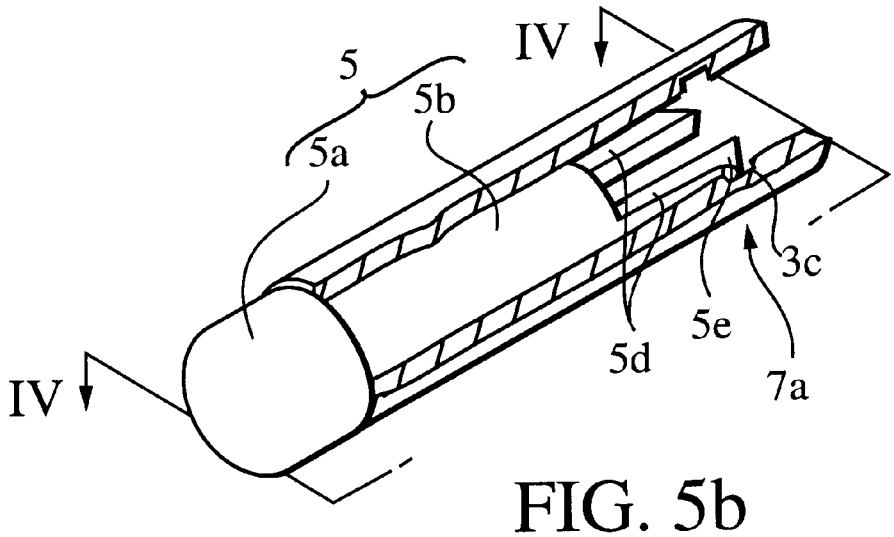
FIG. 5b

SHOCK PREVENTING ELECTRICAL CONNECTOR PLUG

BACKGROUND OF THE INVENTION

1. Field of the Invention

The present invention relates to a plug used in connectors for making electrical connections, e.g. for connecting electrical cables. The plug or the connector including such a plug according to the invention may be used with solar cell modules.

2. Description of Background Information

Electrical power generating systems employing solar energy have drawn much attention in recent years. Such systems use solar cells to produce electrical power for domestic appliances. The solar cells are arranged in panels installed, e.g. on a building roof, and produce direct current, which is subsequently transformed into alternating current through an inverter, a power transformer, an accumulator, etc. The alternating current thus produced is used to feed electrical appliances.

A solar cell panel includes a plurality of solar cell modules connected in series. The modules are connected by purpose-designed connectors each consisting of a plug and socket. Usually, a plurality of solar cell panels are connected together to form a solar cell array. The solar cell panels can also be connected together using connectors similar to those used for connecting solar cell modules.

With this kind of connector, there is a risk that personnel can receive electrical shocks by touching the terminal portion of the plug. In the construction of the aforementioned solar energy based electrical power generating systems, solar cell modules are first installed e.g. on a roof, and only afterwards the electrical connections are made. When the solar cell modules are mounted, lead lines between the modules may already be at a certain voltage level. If personnel touch these lead lines, they risk receiving an electrical shock.

Various measures have been taken in order to avoid risks of electrical shock. For example, according to a prior art device disclosed in Japanese Patent Application published under number HEI-8-203593, the plug and the socket that form a connector are respectively coated with an insulator. For instance, the conductive core of the plug is covered with a cylindrical insulator (housing). In addition, the end opening of the housing is capped with a lid, so that the edge of the plug element is not exposed. As a result, personnel can safely touch the connectors with their bare hands when installing them.

However, the structure of the insulator becomes rather complicated with this plug configuration. Moreover, supplementary work is needed for opening or closing the lid.

Another prior art device is disclosed in Japanese Patent Application published under number HEI-9-148004. According to this disclosure, a cable is first led out from a solar cell module, and the end portion of this cable is connected to a plug core. The end portion of the plug core is then fitted with a cylindrical insulator having a diameter about the same as, or slightly smaller than, the outer diameter of the plug core. By adopting such protective means, a metallic portion is prevented from being exposed at the end opening of the cylindrical insulator.

As the electrically conductive plug tip is not exposed, there is no risk of electrical shock, e.g. by finger contact. However, the insulator disclosed in Japanese Application HEI-9-148004 is fitted onto the plug tip by threading or other equivalent means. Therefore, the plug core or the insulator must be configured specifically for that kind of fastening. Moreover, fitting the insulator may require additional labor. Instead of being threaded, the plug tip may be cut into a sharpened form and covered with an insulating resin. However, the cutting work in this case is time consuming and thus leads to increased production costs.

SUMMARY OF THE INVENTION

An object of the present invention is therefore to solve the above-mentioned problem and provide a connector that protects against electrical shock. The connector as defined in the present invention includes a plug serving as male terminal, and a socket serving as female terminal. The plug, in turn, includes a conductive plug core, an insulator, and an insulating housing. According to the invention, the end portion of the plug can be easily capped with the insulator. Furthermore, the plug can be manufactured in a relatively easy and economical way.

To this end, there is provided a plug for making electrical connections, the plug includes a plug core having a cylindrical form and a plug head portion, an insulator including a cap portion protruding from the plug head portion, and a trunk portion adapted for fitting into the plug core, and the cap portion and the trunk portion being integrally formed. The plug also includes an insulating housing having a cylindrical form and covering the plug core so as to form a space adapted for receiving part of a socket, the plug core and the trunk portion are provided respectively with first and second fixing mechanism, such that, when the trunk portion is fitted into the plug core, the insulator and the plug core are firmly fixed.

The plug core may further include an intermediate portion. The first fixing mechanism is then provided in the intermediate portion and includes dents, recessed portions, dimples or holes. The trunk portion of the insulator has a longitudinal direction and further includes a base portion located distal from the cap portion in the longitudinal direction, whilst the second fixing mechanism is provided on the base portion and includes elongate elastic members having hooking portions, so that, when the insulator is fitted into the plug core, the elongate elastic members are engaged with the dents, recessed portions, dimples or holes.

Preferably, the first fixing mechanism includes a circular channel formed on the inner surface of the intermediate portion along the circumferential direction thereof.

Advantageously, the plug is made of a metal plate and is continuously press-formed in successive dies.

There is also provided a connector that includes the plug and a socket adapted for connecting with the plug.

With the plug structure according to the invention, the mere action of fitting the trunk portion of the insulator into the cylindrical plug core causes the corresponding fixing mechanism to be clasped. The insulator thus has a simple structure and can be fixed securely. Fixing of the insulator into the plug core is also very easy.

With the plug used in a connector for making electrical connections, the insulator is prevented from slipping out of the plug core. Although the fixing mechanisms have a very simple structure, the insulator is nonetheless easily and securely fitted into the plug core.

In a preferred embodiment, a circular channel is provided on the inner surface of the intermediate portion of the plug core, along the circumferential direction thereof.

The latter type of plug core is even more advantageous than the one of the previous embodiment. When fitting the insulator into the plug core, the insulator may take on any position in the circumferential direction, i.e. the insulator may be set at any rotary position around the axis. By merely inserting and pressing the insulator into the plug core, the hooking edge of the elongate elastic members fits into the circular channel. Therefore, when fitting the insulator into the plug core, positioning in the circumferential direction is no longer required. Workability is therefore improved.

The plug used in the above-mentioned electrical connector may be manufactured as follows: a metal plate is prepared for making a plug core, and is continuously press-formed in successive dies. The manufacturing method is thus simpler compared to the cutting method, and costs are therefore reduced.

BRIEF DESCRIPTION OF THE DRAWINGS

The above and other objects, features and advantages of the present invention will be made apparent from the following description of the preferred embodiments, given as non-limiting examples, with reference to the accompanying drawings, in which:

FIG. 2(*b*) is a side elevation view of the plug of FIG. 1;

FIG. 5(*a*) is an exploded perspective view, partially in section, of part of the plug according to another embodiment of the invention;

FIG. 5(*b*) is a perspective view, partially in section, of the plug shown in FIG. 5(*a*) when assembled;

DETAILED DESCRIPTION OF THE PREFERRED EMBODIMENTS

Figure 1:
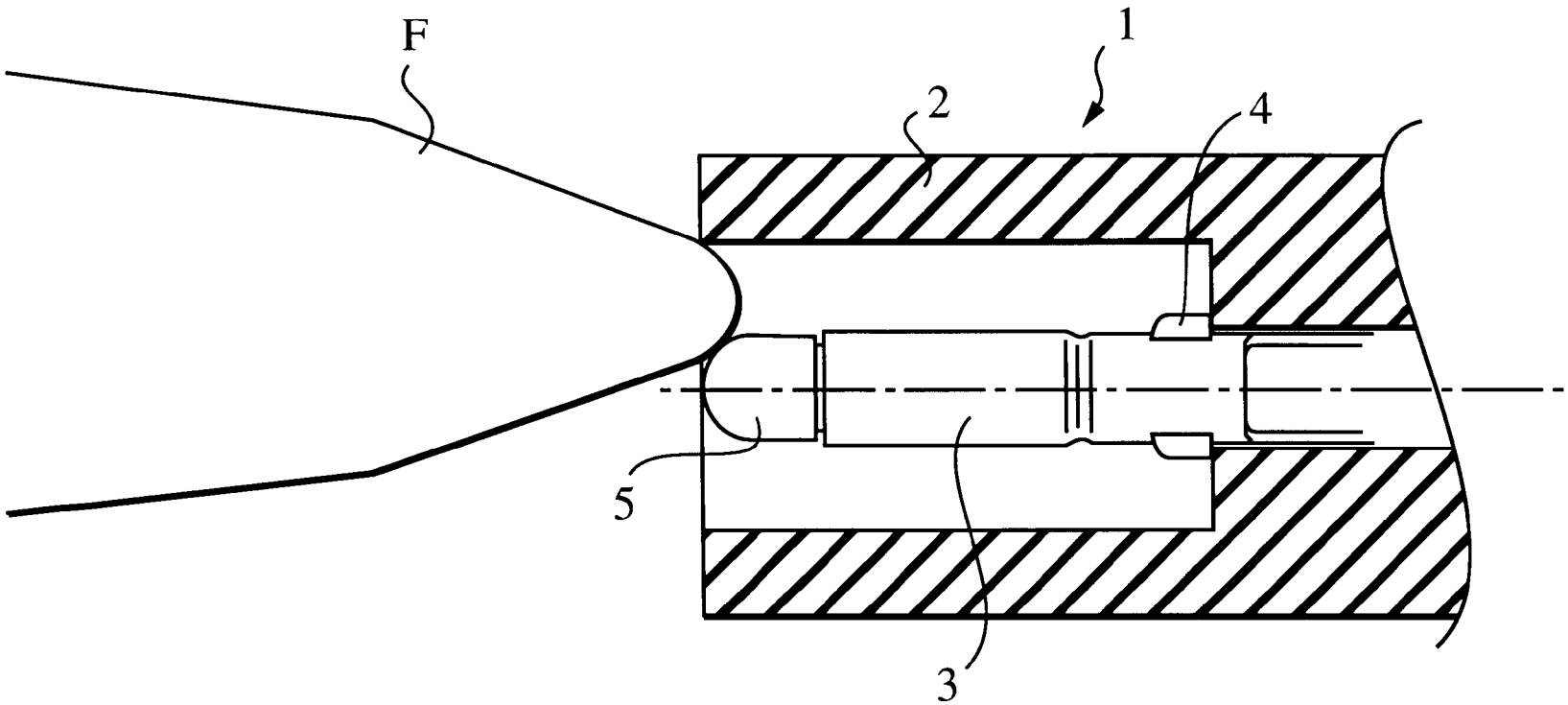
FIG. 1 is a longitudinal cross-sectional, schematic view of part of a plug in accordance with the invention.

FIG. 1 is a longitudinal cross-sectional view of the plug 1 according to one aspect of the present invention. The plug includes a plug core 3 having a cylindrical form, a housing 2 also having a cylindrical form made of an insulating resin, and an insulator 5. As shown in FIG. 1, the housing 2 encloses the plug core 3. The plug core 3 is manufactured from a metal plate by successive passages through a series of dies. The plug core 3 includes a first end which forms a plug head portion, an intermediate plug portion, and a second end that forms a plug foot portion connected to a conductive cable. These three portions are arranged in the axial direction of plug core 3. The plug core 3 is further provided with protrusions 4 which abut against the housing 2 and prevent the plug core 3 from being pulled out from the plug foot end.

Figure 2A:
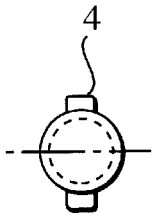
FIG. 2(*a*) is an end view of the plug of FIG. 1.
Figure 2B:
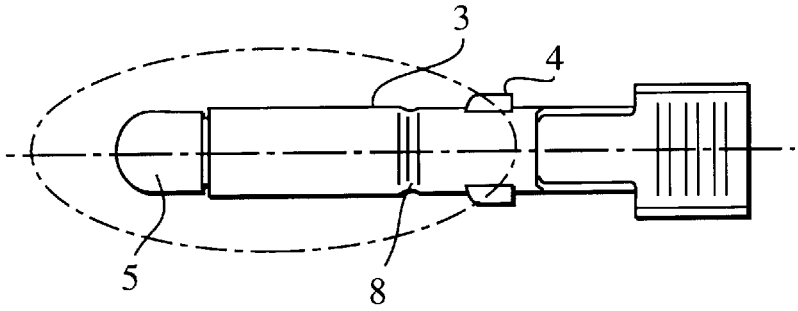

FIG. 2(*a*) is an end view of the plug 1 according to one embodiment of the invention, and FIG. 2(*b*), a side elevation view of the same plug 1.

Figure 3:
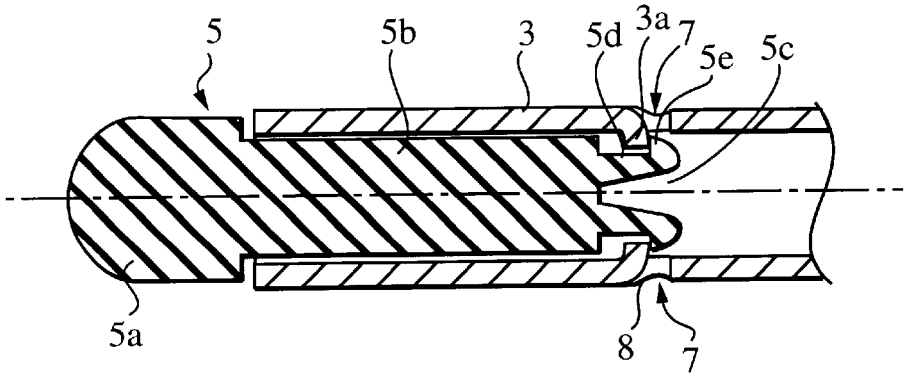
FIG. 3 is an axial cross-sectional view of part of the plug in accordance with the invention, in which a first fixing mechanism is used.

FIG. 3 is a longitudinal cross-sectional view of the plug head portion of plug 1 according to a first embodiment of the invention. As shown in FIGS. 2(*a*) and (*b*) and FIG. 3, the plug core 3 contained in plug 1 also includes an insulator 5 protruding from the plug head portion. The plug core 3 is made of a metallic material having good electrical conductivity. The intermediate plug portion of plug core 3 is provided with first snap members 7 which fit with second snap members 5*c* provided on the insulator 5 described later. The first snap members 7 may include dents, recessed portions, dimples or holes which are formed by cutting out part of the cylindrical wall of the plug core 3 along the circumferential direction. Bent edges 3*a* and 3*a* may then be formed by pressing the cut-out portions radially inwardly. The outer surface of the plug core 3 where the dents, recessed portions, dimples or holes are located may be formed with a circumferential groove 8.

The insulator 5 includes a cap portion 5*a* having an outer diameter about the same as, or slightly smaller than, the outer diameter of plug core 3. Further, the cap portion 5*a* has a rounded tip. The insulator also includes a trunk portion 5*b* which extends from the aforementioned cap portion 5*a* towards the opposite end, where it forms a base portion. The trunk portion has a diameter smaller than that of the cap portion 5*a*, and is adapted to be fitted into the plug core 3. The base portion is provided with second snap members 5*c* which fit with the first snap members 7 of the plug core 3. The second snap members 5*c* include a pair of elongate elastic members 5*d* which extend from the base portion of the insulator 5 along its axial direction, so as to flank the axial centerline at diametrically opposed positions. Further, the tips of the elastic elongate members 5*d* and 5*d* are each provided with a hook portion 5*e* extending diametrically outwardly toward the plug core 3.

The trunk portion 5*b* of insulator 5 is fitted into the plug core 3, so that the hook portions 5*e* of second snap members 5*c* and 5*c* are held against the bent edges 3*a* of plug core 3. When fitting the insulator 5, the hook portions 5*e* of the second snap members 5*c* are stressed against elastically restoring forces and slide against the inside the plug core 3. When the hook portions 5*e* reach the level of bent edges 3*a*, they snap fit against the latter by virtue of the elastic restoring forces.

Moreover, the cap portion 5*a* may be formed into trunk portion 5*b* through a reduced step that can serve as supplementary fixing mechanism. In this case, the reduced step can be arranged so that it abuts against the rim of the core 3 simultaneously as the hook portions 5*e* are snap fitted into the bent edges 3*a* of plug core 3. By virtue of this configuration, there is little movement between insulator 5 and the plug core 3.

Figure 4:
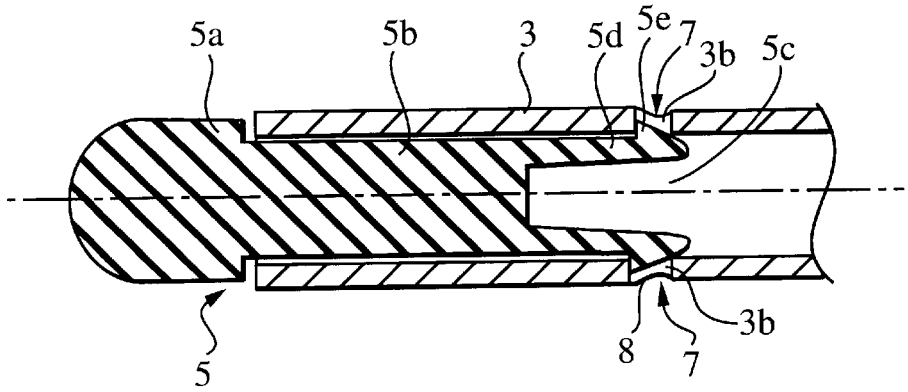
FIG. 4 is an axial cross-sectional view of part of the plug in accordance with a second embodiment of the invention, in which a second fixing mechanism is used.

FIG. 4 is a longitudinal cross-sectional view of part of the plug 1 according to a second embodiment of the invention. In the first embodiment of FIG. 3, hook portions Se fit against bent edges 3*a*. By contrast, in the second embodiment, the first snap member 7 may simply include holes 3*b* in the cylindrical wall of plug core 3. In this case, the hook portions 5*e* engage with the wall portions of holes 3*b*, as shown in FIG. 4.

According to the plug 1 shown in FIG. 1, even when a test finger F is pressed against the opening of the housing 2, it is prevented from entering into the opening, by virtue of the cap portion 5*a* of insulator 5. When making electrical connections, finger contact with plug core 3 is thus positively prevented.

Further, the insulator 5 for safeguarding against electrical shock is fitted with plug core 3 under elastic forces. The structure of plug 1 and its handling is therefore simple.

Figure 6:
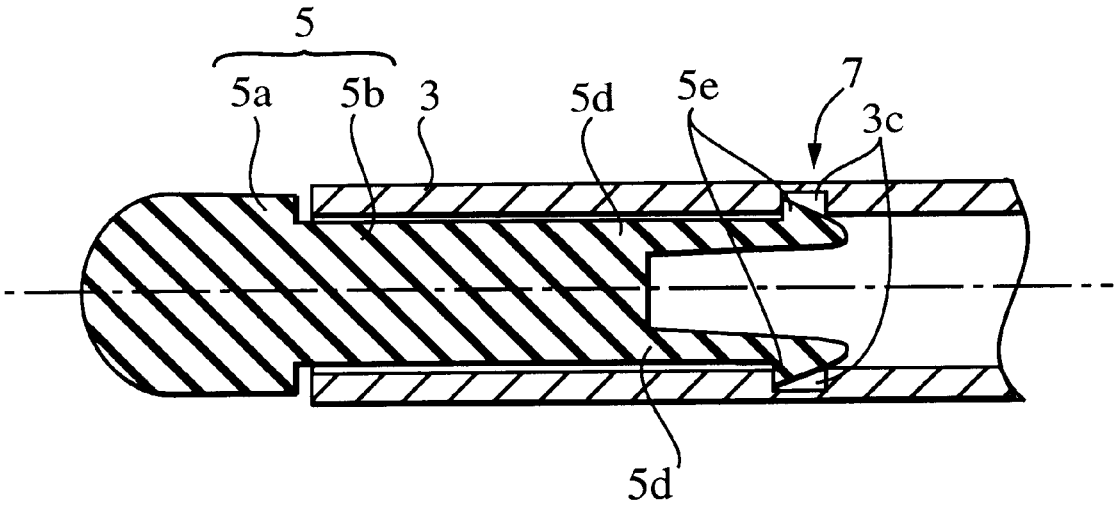
FIG. 6 is a cross-sectional view along line VI—VI of the plug of FIG. 5(*b*)

FIGS. 5(*a*) and (*b*) are perspective views, partially in section, of part of the plug 1 according to a third variant embodiment. FIG. 5(*a*) shows a condition just before insulator 5 is fitted into plug core 3, while FIG. 5(*b*) shows a condition when insulator 5 is fitted into plug core 3. FIG. 6 is a longitudinal cross-sectional view along line VI—VI of the plug 1 shown in FIG. 5(*b*). The third variant embodiment shown in FIGS. 5(*a*) and (*b*) and FIG. 6 has a first snap member 7*a* provided in plug core 3. The first snap member 7*a* is formed by a circular channel 3*c* formed on the inner surface of plug core 3 in the circumferential direction thereof. It replaces the bent edges 3*a* or holes 3*b* of the first and second embodiments. The other constructional features of plug 1 are the same as those in the first and second embodiments.

In the plug 1 according to the third embodiment, it is no longer necessary to adjust the position of insulator 5 in the circumferential direction of plug core 3. In other words, the insulator 5 may be set to be at any rotary position around the axis. When insulator 5 is fitted into plug core 3 and inserted to the limit of its travel, the hooking portions 5*e* of the elastic elongate members are caused to engage into circular channel 3*c*. Working efficiency is thus improved.

Further, instead of forming circular channel 3*c*, a stepwise section may be formed at the position corresponding to circular channel 3*c*. For example, by press-forming, the thickness of plug core 3 may be differentiated at the side including the plug head portion and at the side including the plug foot portion.

Figure 7:
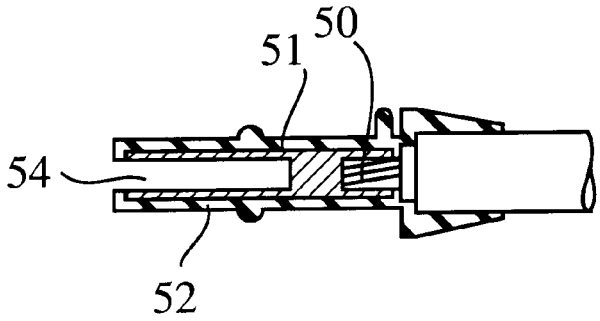
FIG. 7 PRIOR ART
FIG. 7 is a longitudinal cross-sectional view of a conventional connector socket.
Figure 8:
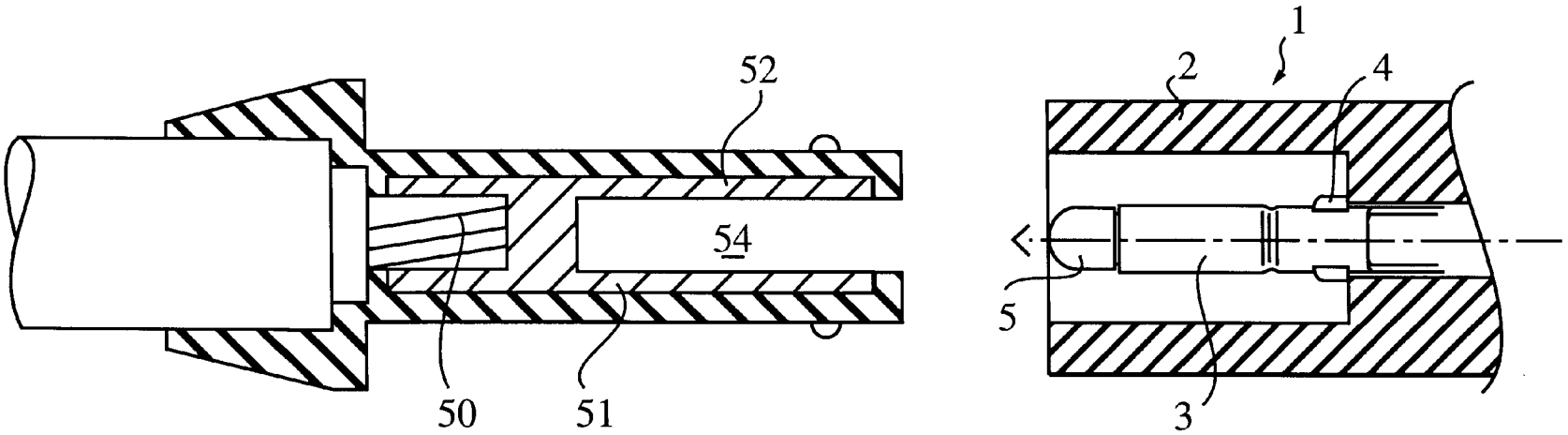
FIG. 8 schematically shows a condition before the plug in accordance with the present invention is fitted with the conventional connector socket of FIG. 7.

The plug 1 is fitted into a socket or receptacle, which may have a structure such as the one shown in FIG. 7, so that the plug core 3 (male terminal) is put into contact with a conductive female terminal 51, and electrical cables are thus connected to each other. In this socket, the conductive female terminal 51 is provided inside a cylindrical insulator 52 and connected to the lead lines 50 of solar cell modules, or the like. The plug 1 is then inserted into a hollow portion 54 of the socket, as schematically shown in FIG. 8. In such a socket, conductive female terminal 51 is not exposed, so that the problem of electrical shock is avoided.

As is clear from the preceding description, the plug for making electrical connections according to the present invention has a cylindrical form and is provided for insertion inside an insulating housing. Further, the plug includes an insulator at its head portion, so as to prevent a finger from entering into the housing through its opening and coming into contact with the electrically conductive plug. The insulator includes a cap portion, and a trunk portion continuously formed therewith through a reducing step. Further, the plug core and insulator are provided with corresponding snap members. When the trunk portion is fitted into the plug core, the insulator and the plug core are secured through both the reduced step and a pair of snap members. The structure of the plug is very simple and the plug can be very easily assembled.

Although the invention has been described with reference to particular mechanism, materials and embodiments, it is to be understood that the invention is not limited to the particulars disclosed and extends to all equivalents within the scope of the claims.

The present disclosure relates to subject matter contained in priority Japanese Applications Nos. HEI-10-104882 and HEI-10-281129, filed on Apr. 15, 1998 and Oct. 2, 1998, respectively, which are herein expressly incorporated by reference in their entireties.

What is claimed is:

1. A plug for making electrical connections, said plug comprising:

a plug core having a cylindrical form and a plug head portion;

an insulator comprising a cap portion protruding from said plug head portion, and a trunk portion constructed and arranged to fit into said plug core, said cap portion and said trunk portion being unitarily formed; and an insulating housing having a cylindrical form and covering said plug core so as to form a space configured to receive part of a socket, said plug core and said trunk portion of said insulator housing being provided respectively with first and second fixing mechanisms, one of said first and second fixing mechanisms comprising at least one elongate elastic member configured to elastically deflect to engage the other of said first and second fixing mechanisms, such that, when said trunk portion is fitted into said plug core, said insulator and said plug core are firmly secured together.

2. The connector according to claim 1, wherein said plug core further comprises an intermediate portion, the other of said first and second fixing mechanisms being provided in said intermediate portion and comprising at least one of dents, recessed portions, dimples and holes, and wherein said trunk portion of said insulator has a longitudinal direction and further comprises a base portion located distal from said cap portion in said longitudinal direction, said at least one elongate elastic member being provided on said base portion and having a hooking portion so that, when said insulator is fitted into said plug core, said at least one elongate elastic member interfits with said at least one of dents, recessed portions, dimples and holes.

3. The plug according to claim 2, wherein said plug core is formed from a metal plate and is continuously press-formed in successive dies.

4. A connector comprising the plug defined in claim 2, and a socket adapted for connecting with said plug.

5. The connector according to claim 1, wherein said plug core further includes an intermediate portion, the other of said first and second fixing mechanisms being provided in said intermediate portion and comprising a circular channel formed on an inner surface of said intermediate portion along the circumferential direction thereof, and wherein said trunk portion of said insulator has a longitudinal direction and further comprises a base portion distal from said cap portion in said longitudinal direction, said at least one elongate elastic member being provided on said base portion and having a hooking portion, so that, when said insulator is fitted into said plug core, said at least one elongate elastic member interfits with said circular channel.

6. The plug according to claim 5, wherein said plug core is formed from a metal plate and is continuously press-formed in successive dies.

7. A connector comprising the plug defined in claim 5, and a socket adapted for connecting with said plug.

8. The plug according to claim 1, wherein said plug core is formed from a metal plate and is continuously press-formed in successive dies.

9. A connector comprising the plug defined in claim 8, and a socket adapted for connecting with said plug.

10. A connector comprising the plug defined in claim 1, and a socket adapted for connecting with said plug.

11. A plug for making electrical connections, said plug comprising:

a plug core having a cylindrical form and a plug head portion;

an insulator comprising a cap portion protruding from said plug head portion, and a trunk portion constructed and arranged to fit into said plug core, said cap portion and said trunk portion being unitarily formed;

an insulating housing having a cylindrical form and covering said plug core so as to form a space configured to receive part of a socket, said plug core and said trunk portion of said insulator housing being provided respectively with first and second fixing mechanisms, such that, when said trunk portion is fitted into said plug core, said insulator and said plug core are firmly secured together; and wherein said plug core further comprises an intermediate portion, said first fixing mechanism being provided in said intermediate portion and comprising at least one of dents, recessed portions, dimples and holes, and wherein said trunk portion of said insulator has a longitudinal direction and further comprises a base portion located distal from said cap portion in said longitudinal direction, said second fixing mechanism being provided on said base portion and comprising at least one elongate elastic member having a hooking portion so that, when said insulator is fitted into said plug core, said at least one elongate elastic member interfits with said at least one of dents, recessed portions, dimples and holes.

12. The plug according to claims 11, wherein said plug core is formed from a metal plate and is continuously press-formed in successive dies.

13. A connector comprising the plug defined in claims 11, and a socket adapted for connecting with said plug.

14. A plug for making electrical connections, said plug comprising:

a plug core having a cylindrical form and a plug head portion;

an insulator comprising a cap portion protruding from said plug head portion, and a trunk portion constructed and arranged to fit into said plug core, said cap portion and said trunk portion being unitarily formed; and an insulating housing having a cylindrical form and covering said plug core so as to form a space configured to receive part of a socket, said plug core and said trunk portion of said insulator housing being provided respectively with first and second fixing mechanisms, such that, when said trunk portion is fitted into said plug core, said insulator and said plug core are firmly secured together; and wherein said plug core further includes an intermediate portion, said first fixing mechanism being provided in said intermediate portion and comprising a circular channel formed on an inner surface of said intermediate portion along the circumferential direction thereof, and wherein said trunk portion of said insulator has a longitudinal direction and further comprises a base portion distal from said cap portion in said longitudinal direction, said second fixing mechanism being provided on said base portion and comprising at least one elongate elastic member having a hooking portion, so that, when said insulator is fitted into said plug core, said at least one elongate elastic member interfits with said circular channel.

15. The plug according to claims 14, wherein said plug core is formed from a metal plate and is continuously press-formed in successive dies.

16. A connector comprising the plug defined in claims 14, and a socket adapted for connecting with said plug.

* * * * *